US005975544A

United States Patent [19]

Kresse et al.

[11] Patent Number: 5,975,544

[45] **Date of Patent: *Nov. 2, 1999**

[54] TRANSPORT TROLLEY WITH A CHASSIS AND UPRIGHTS

[75] Inventors: Franz Kresse, Hilden; Roland Schunter, Lorch; Rainer Osberghaus, Duesseldorf; Hans-Leo Fernschild, Korschenbroich, all of Germany

[73] Assignee: Henkel-Ecolab GmbH & Co. OHG, Duesseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/702,506

[22] PCT Filed: Feb. 22, 1995

[86] PCT No.: PCT/EP95/00634

§ 371 Date: Sep. 3, 1996

§ 102(e) Date: Sep. 3, 1996

[87] PCT Pub. No.: WO95/23548

PCT Pub. Date: Sep. 8, 1995

[30] Foreign Application Priority Data

Mar. 3, 1994 [DE] Germany ..... 44 07 014

[51] Int. Cl.[6] ..... B62B 3/02

[52] U.S. Cl. ..... 280/47.35; 211/133.1; 248/903; 280/79.3

[58] Field of Search ..... 211/133.1, 189; 280/47.35, 79.3, 79.2, 47.34; 182/87; 248/351, 357, 903

[56] References Cited

U.S. PATENT DOCUMENTS

| | | | |
|---|---|---|---|
| D. 90,704 | 9/1933 | Goodman | 280/47.35 X |
| 681,098 | 8/1901 | Brown | 211/133.1 |
| 1,804,997 | 5/1931 | Manley | 280/79.3 |
| 1,900,867 | 3/1933 | Olds | 280/79.2 X |
| 2,774,609 | 12/1956 | Winger | 280/79.1 |
| 3,788,662 | 1/1974 | Rasmussen et al. | 280/79.2 X |
| 4,165,088 | 8/1979 | Nelson | 280/47.35 |
| 4,427,379 | 1/1984 | Duran et al. | 280/79.3 X |
| 4,940,150 | 7/1990 | Spengler | 211/133.1 X |
| 5,330,064 | 7/1994 | Hall | 280/79.3 X |

FOREIGN PATENT DOCUMENTS

| | | |
|---|---|---|
| 1265508 | 5/1961 | France . |
| 2110269 | 6/1972 | France . |
| 3937189 | 5/1991 | Germany . |
| 651791 | 10/1985 | Switzerland . |
| 2161374 | 1/1986 | United Kingdom . |

*Primary Examiner*—J. J. Swann
*Assistant Examiner*—Michael Mar
*Attorney, Agent, or Firm*—Ernest G. Szoke; Wayne C. Jaeschke; Kenneth Watov

[57] ABSTRACT

The present trolley is suitable for accommodating and conveying containers and apparatus for the commercial cleaning and disinfecting of floors and other surfaces, and as a collector for valuable substances and for other tasks involved in the commercial cleaning of buildings. The trolley has a base plate and substantially vertically aligned uprights. The base plate comprises at least one downwardly projecting shaft which is suitable for accommodating the uprights, and is additionally connected by struts to the underside of the base plate. The danger of breakage at the points where the uprights are secured to the base plate is considerably reduced.

8 Claims, 1 Drawing Sheet

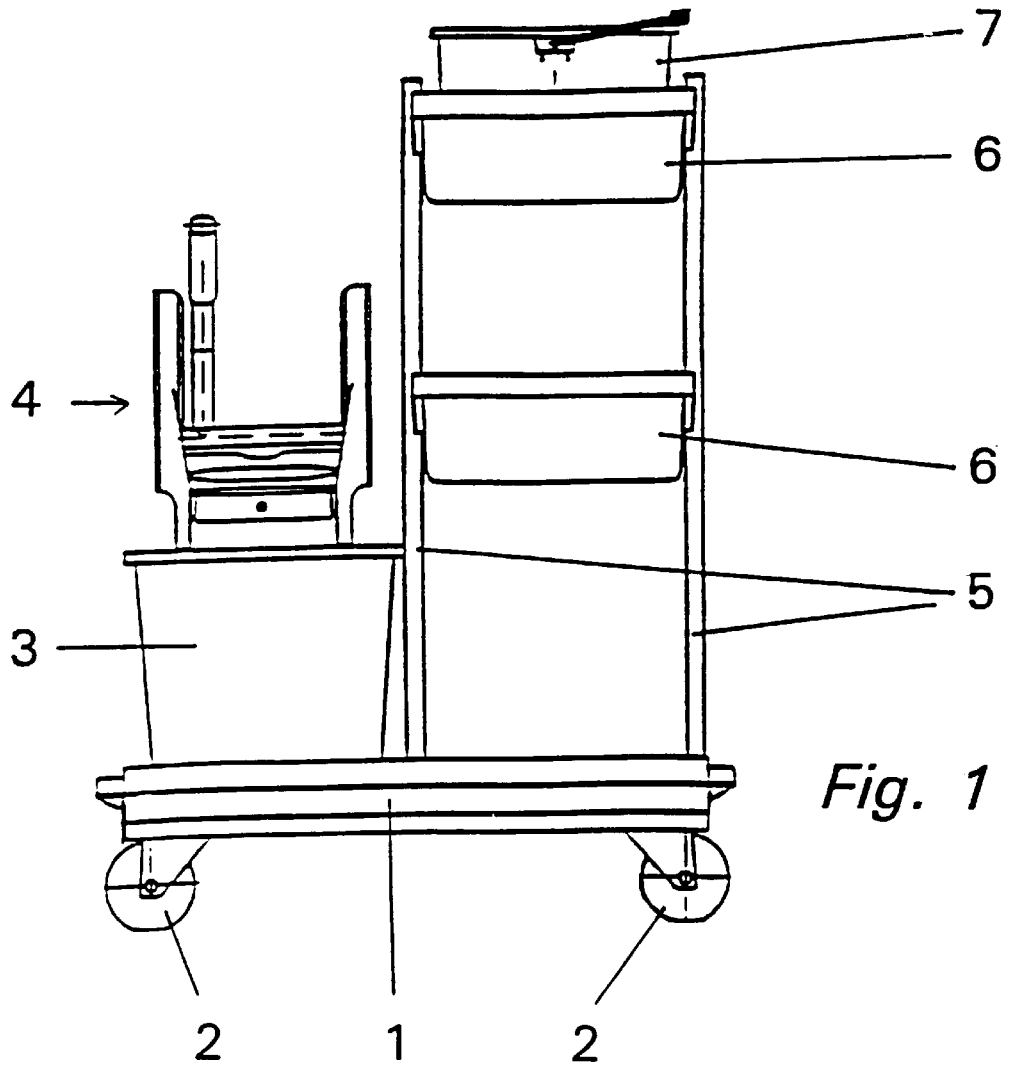
Fig. 1
Fig. 2
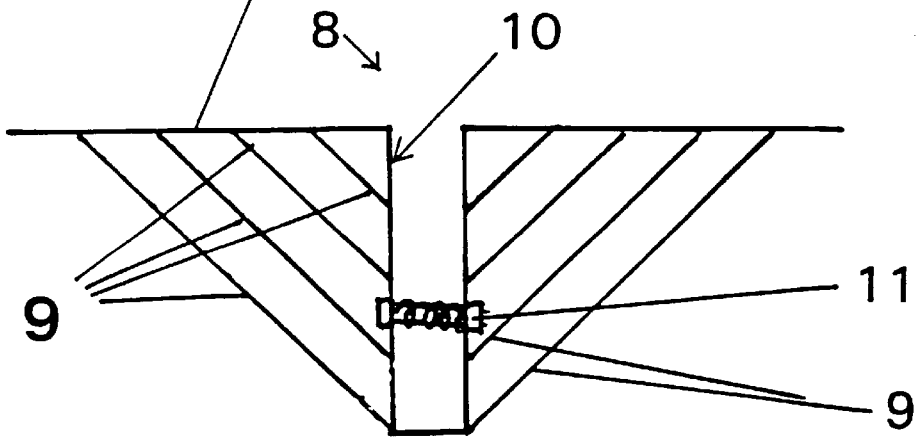

TRANSPORT TROLLEY WITH A CHASSIS AND UPRIGHTS

BACKGROUND

1. Field of the Invention

This invention relates to a transport trolley suitable for accommodating and transporting containers and utensils for the institutional cleaning and disinfection of floors and other surfaces, as a useful-material collector and for other tasks in the institutional cleaning of buildings, comprising a chassis also known as the baseplate and substantially vertical uprights.

2. Discussion of Related Art

Known transport trolleys are used as disinfection or waste-disposal trolleys or as useful-material collectors. They are also used in the institutional cleaning of buildings as so-called cleaning or equipment trolleys for carrying buckets for the cleaning liquid and the dirty water, floor mops, rubbish sacks and other utensils. The term "transport trolley" is used in the present specification for all these and similar trolleys.

Known transport trolleys offer more or less large useful surfaces for carrying cleaning utensils. They are particularly suitable for accommodating buckets, for example for cleaning liquids and dirty water, and relatively small cleaning utensils. However, the surface area of the base plate is generally not sufficient. Accordingly, uprights are mounted on the base plate, inter alia to carry transport trays, as known for example from DE 39 37 189 A1.

However, problems are involved in fixing the uprights to the chassis. In the prior art, the uprights are welded to the base plate or are joined thereto by a screw which is guided through the chassis and screwed into a nut let into the end of the upright. In use, however, such powerful lever forces act on the upright/chassis joint that the end of the upright often breaks.

SUMMARY OF THE INVENTION

Accordingly, an object of the present invention is to provide inexpensive means to fix the upright(s) of a transport trolley to its base plate in such a way that the danger of breakage is greatly reduced.

The present invention meets the above objects and others by providing a base plate comprising at least one downwardly projecting shaft which is suitable for receiving the uprights and which is additionally fixed to the bottom of the base plate by stays. The upright fitted into the shaft is fixed by stays to a relatively large area of the base plate. Accordingly, there is no danger of the shaft being dislodged with the upright fitted therein.

A particularly stable connection between the upright and the base plate is established if the stays surround the shaft on all sides.

The stays may differ in their nature and configuration. In one preferred embodiment, extremely stable stays involving relatively little consumption of material assume the form of flat lamellae.

Particular and possibly elaborate precautions to secure the uprights in the shafts are unnecessary if the opening of the shaft is accurately adapted in its dimensions to the corresponding upright.

In addition, a tightening screw for pressing the shaft onto the upright is advantageous as an additional safeguard, the tightening screw passing in particular both through the shaft and through the upright. A friction-locking and interlocking connection between the upright and the base plate is established in this way.

The invention does not involve any expensive modifications to the process used to make the transport trolley. In one particularly preferred embodiment, the base plate is made in one piece with shafts and stays from plastic material. Accordingly, the chassis can be produced with the shafts in a single operation. The use of plastic has the further advantage that no corrosion problems arise in the use of the transport trolley.

The mechanical stability of the transport trolley is further increased if the uprights are joined, more particularly screw, to one another and to the remaining superstructure of the base plate.

The invention is not limited to uprights of a particular type and size where the base plate comprises shafts differing in size of which only some have to be used. Several shafts of various sizes arranged closely adjacent one another on the base plate may also be provided without any adverse effect on the stability of the base plate because the stays integrally formed in accordance with the invention more than compensate for the loss of stability through the shafts. To improve handling and also the visual appearance, cover caps are proposed for the unused shafts.

BRIEF DESCRIPTION OF THE DRAWINGS

One example of embodiment of the invention is described in detail in the following with reference to the accompanying drawings, in which like items are identified by the same reference designation, wherein:

FIG. 1 is a side elevation of one embodiment of a transport trolley in which the invention may be used.

FIG. 2 is a vertical section through part of the chassis of the trolley shown in FIG. 1.

DETAILED DESCRIPTION OF THE INVENTION

The transport trolley shown in FIG. 1 consists of a stable base plate 1 with rollers 2 on which a container 3 with cleaning aids is arranged. A press 4 for floor mops is mounted on the container 3. Uprights 5 to which transport trays 6 are screwed are fixed to the base plate 1. The trays increase the carrying capacity of the trolley and, for example, can accommodate another bucket 7.

The chassis 1 is made entirely of plastic. Shafts 8 (of which only one is shown in FIG. 2) are molded into the surface of the base plate. To increase stability, the shafts 8 are surrounded by flat lamellae 9 which join the outside 10 of the shaft 8 to the underneath of the base plate 1. The openings of the shafts 8 are accurately adapted in their dimensions to the uprights 5.

Each upright 5 is inserted at its lower end into the opening of the associated shaft 8. The dimensional accuracy of the upright 5 and the shaft 8 is sufficient to guarantee a sufficiently firm fit for the use of the trolley. As shown in FIG. 2, a connecting screw 11 is additionally provided, passing through the outside 10 of the shaft and the end of the upright 5 (not shown in FIG. 2). When tightened, the screw 11 establishes a particularly stable connection between the upright 5 and the base plate 1.

A wide variety in the choice of superstructures is made possible by a plurality of shafts with various opening cross-sections. Those shafts which are not in use are covered by caps so that they do not interfere with the use of the trolley. Such other embodiments and modifications that may occur to those of skill in the art are meant to be covered by the spirit and scope of the appended claims.

List of Reference Numerals

1 Base plate
2 Roller
3 Container
4 Press
5 Upright
6 Carrying tray
7 Bucket
8 Shaft
9 Lamella, stay
10 Shaft surface
11 Connecting screw, tightening screw

What is claimed is:

1. A transport trolley suitable for accommodating and transporting containers and utensils for the institutional cleaning and disinfection of floors and other surfaces, as a useful-material collector and for other tasks in the institutional cleaning of buildings, comprising:

a base plate having a top and a bottom;

a plurality of substantially vertical uprights for mounting at various desired locations on said base plate;

said base plate including a plurality of through holes located at the desired locations for mounting said plurality of vertical uprights, respectively;

a plurality of downwardly projecting elongated hollow shafts located beneath respective ones of said plurality of holes on the bottom of said base plate at the desired locations for said plurality of vertical uprights, respectively, said plurality of hollow shafts each being suitable for receiving individual ones of said plurality of uprights, respectively; and a plurality of struts positioned radially around each one of said plurality of hollow shafts, each strut including a plurality of vertically separated flat stays having planar surfaces arranged in parallel alignment, each flat stay of each strut having a lower end rigidly connected to an outer wall of said hollow shaft at an acute angle therebetween and an upper end rigidly connected to the bottom of said base plate for stabilizing said plurality of hollow shafts, wherein said base plate is made in one piece with said hollow shafts molded integrally therewith from a plastic material.

2. A transport trolley as claimed in claim 1, wherein the stays surround the shaft on all sides.

3. A transport trolley as claimed in claim 1, wherein the stays are in form of flat lamellae.

4. A transport trolley as claimed in claim 1, wherein the dimensions of the opening of the shaft are accurately adapted to the corresponding upright.

5. A transport trolley as claimed in claim 1, further including a tightening screw for pressing the shaft onto the upright, the tightening screw passing both through the shaft and through the upright.

6. A transport trolley as claimed in claim 1, wherein the uprights are joined to one another and to remaining superstructure of the base plate.

7. A transport trolley as claimed in claim 1, wherein the base plate includes shafts of various sizes.

8. A transport trolley as claimed in claim 1, further including cover caps on unused shafts.

* * * * *